US006575469B2

(12) United States Patent
Love

(10) Patent No.: US 6,575,469 B2
(45) Date of Patent: Jun. 10, 2003

(54) THREE-DIMENSIONAL GAME TARGET

(76) Inventor: Timothy W. Love, 1696 Lucas Dr., Knoxville, IA (US) 50138

( * ) Notice: Subject to any disclaimer, the term of this patent is extended or adjusted under 35 U.S.C. 154(b) by 0 days.

(21) Appl. No.: 10/054,283

(22) Filed: Nov. 12, 2001

(65) Prior Publication Data

US 2002/0113372 A1 Aug. 22, 2002

Related U.S. Application Data

(60) Provisional application No. 60/269,932, filed on Feb. 21, 2001.

(51) Int. Cl.[7] ..... F41J 3/00
(52) U.S. Cl. ..... 273/403; 273/408
(58) Field of Search ..... 273/403, 404, 273/407, 408

(56) References Cited

U.S. PATENT DOCUMENTS

| | | | | | |
|---|---|---|---|---|---|
| 2,090,930 | A | * | 8/1937 | Chubb | 273/408 |
| 2,726,870 | A | * | 12/1955 | Auger | 273/370 |
| 3,476,390 | A | | 11/1969 | Roloff et al. | |
| 3,729,197 | A | | 4/1973 | Swanson et al. | |
| 3,762,709 | A | | 10/1973 | Roloff et al. | |
| 4,054,288 | A | | 10/1977 | Perrine, Sr. | |
| 4,203,600 | A | * | 5/1980 | Brown | 273/407 |
| 4,477,082 | A | | 10/1984 | McKenzie et al. | |
| 4,565,376 | A | | 1/1986 | Croll | |
| 4,643,434 | A | | 2/1987 | Carlin | |
| 5,467,999 | A | | 11/1995 | Valencic et al. | |
| 5,503,403 | A | | 4/1996 | Morrell | |
| 5,593,162 | A | * | 1/1997 | Minuskin | 273/403 |
| 5,649,708 | A | * | 7/1997 | Podlesny | 273/403 |
| 5,669,610 | A | * | 9/1997 | Salyers | 273/403 |
| 6,254,100 | B1 | * | 7/2001 | Rinehart | 273/403 |

OTHER PUBLICATIONS

Thompson Target Technology, "Big Buck" Deer Targets, Canton, Ohio, USA, 1997–1998 on the Internet.
Unknown, 3D Animal Targets, on the Internet at least as early as Feb. 21, 2001.
McKenzie, 3D Animal Targets, pp. 1 & 2, at least as early as Feb. 21, 2001 on the Internet.
Browning, Paragon™ Targets, pp. 24–25, at least as early as Feb. 21, 2001.

* cited by examiner

*Primary Examiner*—Mark S. Graham
(74) *Attorney, Agent, or Firm*—McKee, Voorhees & Sease, P.L.C.

(57) ABSTRACT

A three-dimensional target includes a target shell shaped into the form of an animal and a three-dimensional removable target insert bearing indicia of the animal's vital organs. The target insert slidably inserts into a vital organ cavity formed in the shell. The target allows the shooter to more accurately assess the internal penetration and effectiveness of his or her shots.

10 Claims, 8 Drawing Sheets

THREE-DIMENSIONAL GAME TARGET

CROSS-REFERENCE TO RELATED APPLICATIONS

This application claims the benefit of U.S. provisional Application No. 60/269,932, filed Feb. 21, 2001.

GRANT REFERENCE

Not applicable.

BACKGROUND OF THE INVENTION

The present invention is directed to the field of targets. More particularly, this invention concerns a three-dimensional archery target having an animal-shaped body and a removable three-dimensional target insert that simulates the animal's vital organs. The archery target not only provides a longer lasting archery target, but also provides a practice experience more closely related to actual bow hunting of game animals. Regardless of the archer's firing position relative to the target, an indication of the accuracy, internal penetration and likely damage of the shot is readily observable.

Conventional three-dimensional life-size animal-simulating archery targets suffer from several drawbacks. Conventional targets are typically formed from a single piece of molded foam having a shape resembling that of a game animal, for example a deer or a bear. The archers usually stand to the side of the target and aim at the chest area because puncturing a vital organ located in the chest cavity, such as the heart or lungs, of the animal simulated by the target is the most humane and expedient way to kill the animal. Unfortunately, using the target in this manner causes relatively quick destruction of the side surfaces of the target due to repeated strikes from arrows. The user must soon replace the entire target, which involves a substantial expenditure. Second, horizontal broadside shots are rare in actual hunting experience. Typically the hunter fires an arrow from a tree stand located above the animal or a crouching or prone position located below the animal. The arrow often approaches the animal from the front or rear. It is difficult to tell with single-piece molded foam targets whether such skewed shots would be accurate or effective in reaching the vital organs of an animal in real life.

One attempt at increasing the useful life of a foam target is described in U.S. Pat. No. 5,503,403 issued to Morrell and entitled "Three-Dimensional Archery Target." The archery target includes an elongated, substantially cylindrical target insert adapted to be received in and substantially fill a cutout in the chest area of the foam body. In one embodiment, the target further includes a thin body cover for covering the target insert and the cutout so as to provide a uniform appearance of the exterior of the game animal target. The body cover includes a two-dimensional representation of a bull's eye, scoring rings, or depiction of vital organs on the exterior thereof to indicate the primary aiming point for arrows directed at the target. It is disclosed that the body cover can be omitted and a bull's eye or scoring rings could be painted or printed on the side of the target insert. In one embodiment, a free floating central core of a penetration resistant material resides inside the target insert. The free floating central core is oriented parallel to the front and back surfaces of the target insert and serves to absorb arrow impacts without being penetrated. The free floating core is concealed within the target insert and is not readily removable or viewable. While the Morrell target has increased useful life, it fails to specifically address the problem of providing more accurate information concerning regarding the internal penetration of shots.

Therefore, there is a need for an improved three-dimensional life-size animal-simulating archery target that is longer lasting and more accurately scores arrow shots according to the damage they might inflict on the vital organs of an animal in real life.

Thus, a primary objective of the present invention is the provision of an improved three-dimensional archery target.

A further objective of the present invention is the provision of an archery target having a removable three-dimensional vital organ insert slidably inserted in a vital organ cavity within the game target shell.

A further objective of the present invention is the provision of a target insert having a three-dimensional representation of the vital organs of an animal thereon.

A further objective of the present invention is the provision of a three-dimensional animal-simulating archery target that more accurately detects whether arrows have struck the location of the animal's vital organs.

A further objective of the present invention is the provision of a three-dimensional archery target that accurately scores non-broadside arrow shots.

These and other objectives will become apparent from the drawings, as well as from the description and claims that follow.

BRIEF SUMMARY OF THE INVENTION

The present invention is directed to the field of targets in general and, more specifically, to hunting or archery targets. The invention provides a three-dimensional archery target that has a shell shaped into the form of an animal, including but not limited to a deer, bear, elk, etc. The shell has a vital organ cavity formed therein. A removable target insert bearing indicia, preferably three-dimensional, of the animal's vital organs slidably inserts into the cavity through an opening in the shell. The target allows the archer to view the internal penetration of the arrow and more accurately assess or "score" the shot. Exemplary embodiments disclosed herein show the target shaped like a deer, a bear on all four legs, and a bear standing on its hind legs, but the invention could be adapted to resemble any animal. The invention also provides a unique method of determining the accuracy of archery shots. The invention is directed to improving a shooter's accuracy by allowing him or her to see the internal penetration of his or her shots, which applies to the hunting field but is not necessarily limited thereto.

DETAILED DESCRIPTION OF THE INVENTION

Figure 1:
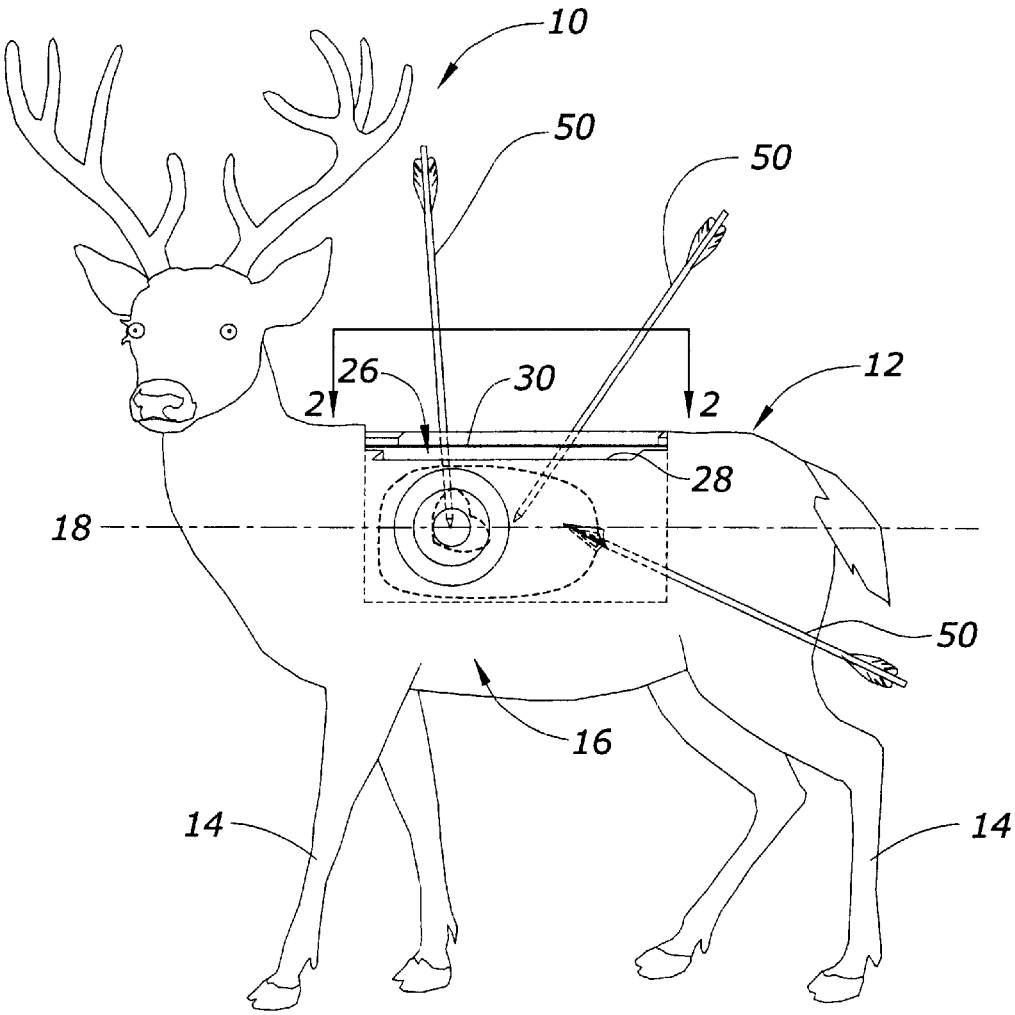
FIG. 1 is a perspective view of a three-dimensional archery target simulating a deer according to the present invention.

In accordance with an exemplary embodiment of the invention shown in FIG. 1, a three-dimensional life-size animal-simulating archery game target is generally designated by the reference numeral 10. The target 10 has a shell 12 formed into the shape of an animal, such as a deer. The shell 12 is constructed of a molded polyurethane foam that is well known and conventional in the three-dimensional game target art. Preferably the density of the foam used to construct the shell 12 is similar to the density of the actual animal's flank so that a realistic target results. The foam shell 12 is supported in an upright position by a plurality of legs 14 that can be anchored to the ground in a conventional manner. The general construction of deer-like and bear-like foam targets are disclosed by Morrell in U.S. Pat. No. 5,503,403, and therefore will not be repeated in detail herein.

Figure 2:
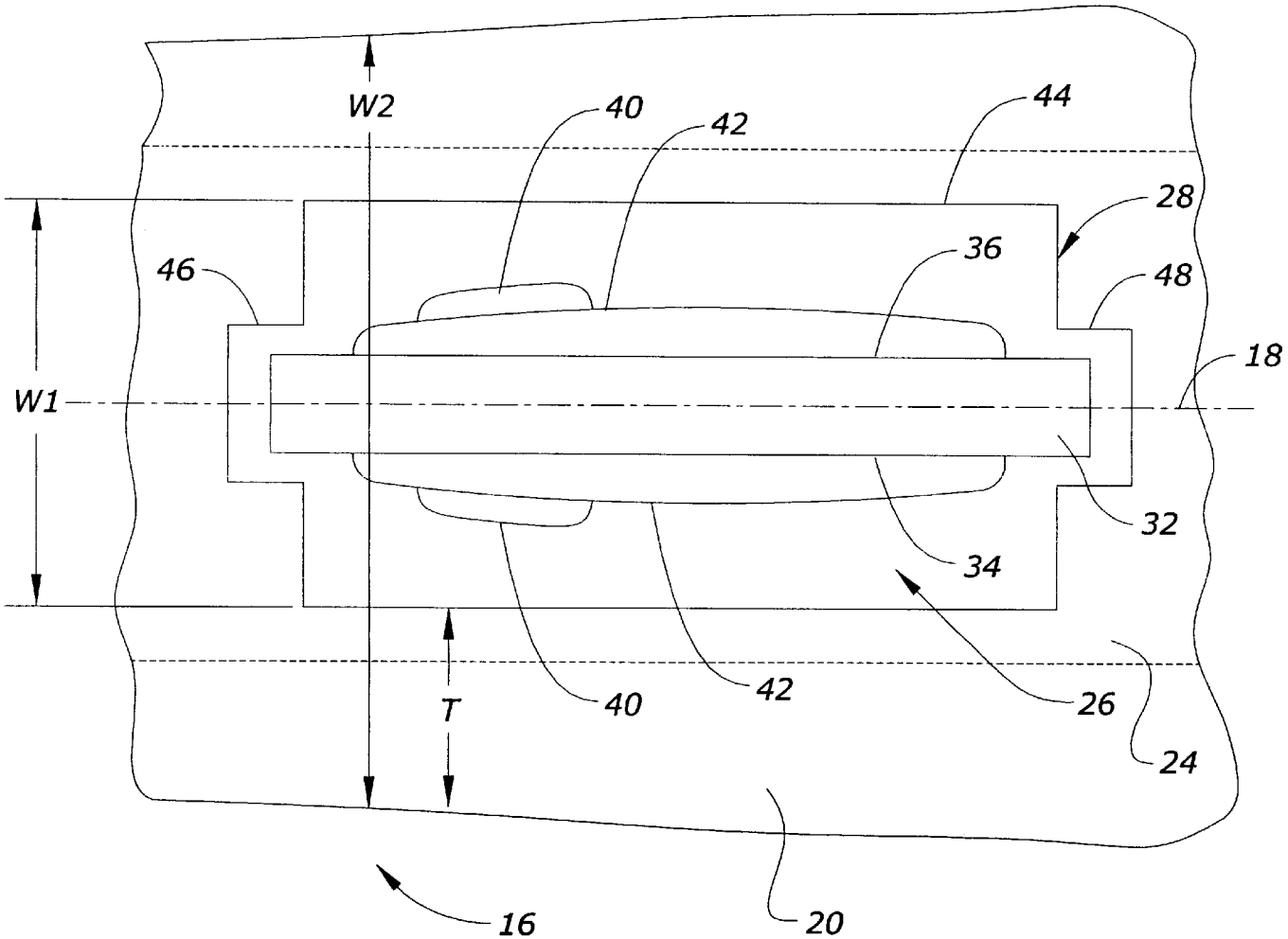
FIG. 2 is a partial top plan view of the chest, torso, or thorax portion of the deer target of FIG. 1 and shows the three-dimensional vital organ removable target insert of this invention.
Figure 3:
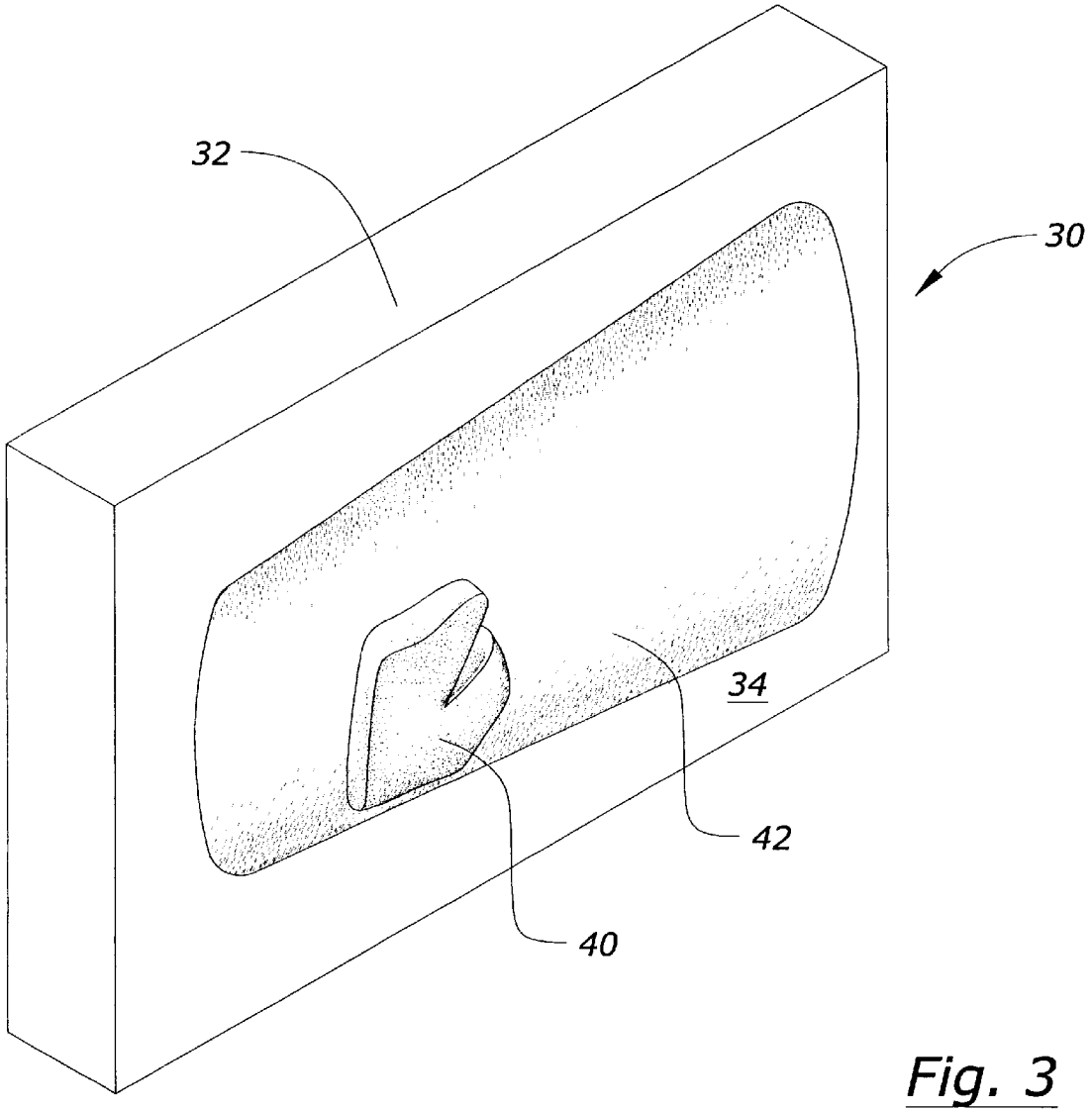
FIG. 3 is a perspective view of the target insert of FIG. 2.

The shell 12 has a torso, thorax, or chest portion 16 that is preferably bisected into substantially identical shell halves by a central vertical plane that includes the longitudinal axis 18 of the target 10. As best seen in FIG. 2, the thorax portion 16 includes a pair of outer or distal sections 20, 22 and a proximal or inner section 24 located therebetween. The inner section 24 has a vital organ cavity 26 therein. The vital organ cavity 26 extends inwardly from an elongated opening 28 in the shell 12. Preferably the opening 28 is in a top portion of the shell 12 in the deer-like target 10 illustrated. The opening 28 has a width W1 substantially less than the overall width W2 of the shell 12 adjacent the opening, i.e.—across the distal or outer (flank) sections 20, 22. Preferably the shell 12 has a wall thickness T adjacent the vital organ cavity 26 that approximately simulates the thickness of the animal's flank or other relevant body feature. In the illustrated embodiment of a deer or similar animal which stands on four legs, the cavity 26 extends along the vertical plane of symmetry of the thorax portion of the shell 12.

A removable target insert 30 slidably inserts in the vital organ cavity 26 through the opening 28. The insert 30 is three-dimensional and has a prismatic insert base 32 with opposing front and rear surfaces 34, 36. Preferably the insert base 32 is rectangular, but other shapes including but not limited to round, oval, etc. will not detract from the invention provided that the shape of the cavity 26 is adjusted accordingly. The front surface 34 bears indicia 38 thereon representing one or more vital organs of the animal. The indicia 38 could be two-dimensional, but preferably includes a three-dimensional heart-shaped member 40 attached to the front surface 34 of the base 32. The heart-shaped member 40 protrudes or extends in a forward direction from the base 32 as shown. Preferably the indicia 38 also includes a three-dimensional lung-shaped member attached to the front surface 34 of the base 32 and protruding therefrom in a similar manner. To enhance the realistic nature, versatility and durability of the target 10 and the insert 30, a second three-dimensional heart-shaped member optionally attaches to and protrudes in a rearward direction from the rear surface 36 of the base 32. Similarly, a second three-dimensional lung-shaped member optionally attaches to the rear surface 36 so as to protrude in a rearward direction therefrom. Thus, it can be seen that the target insert 30 is a rectangular core and raised surfaces protruding therefrom so as to resemble the vital organs of the animal that the target 10 depicts.

The base 32 of the target insert 30 is preferably constructed of a polyurethane foam or other substantially rigid, penetration resistant material. Although a foam with the same density as the shell 12 may be used, preferably the insert base 32 is constructed of a material with a density substantially greater than the density of the shell 12 to stop the arrows 50 from passing through. The heart-shaped member 40 and the lung-shaped member 42 are also preferably formed of polyurethane foam material, but the density is preferably approximately the same or less than the material of the shell 12. More preferably, the material forming the heart-shaped member 40 and lung-shaped member 42 has a density approximating the density of the heart and lungs in an actual animal so as to more closely simulate arrow penetration under hunting conditions. If similar density material is utilized for the insert base 32 and the members 40, 42, the target insert can be integrally molded as a single-piece. If materials of different densities are utilized, the members 10 and 42 (or combinations thereof) attach to the base 32 using solvents, cement for use with urethane foam, staples, or other conventional attachment means.

The opening 28 preferably includes a central portion 44 that is wide enough to slidably receive the central portion of the insert 30 that has the raised indicia 40, 42 of the vital organs thereon. A peripheral gap is maintained between the insert 30 and the walls of at least the central portion 44 of the opening 28 so arrow penetration can be seen. To more effectively restrain and hold the target insert 30 upright, the ends 46, 48 of the opening 28 are preferably stepped to a narrower width than the central portion 44.

To assemble the game target 10, the user slides the target insert 30 into the opening 28 as shown in FIGS. 1 and 2. When the insert 30 becomes damaged or disintegrated by repeated arrow strikes, the user merely removes the insert 30 from the cavity 26 and reverses the front and rear surfaces 34, 36 or replaces it. As discussed below, the target 10 prolongs the life of the shell 12 by allowing both broadside and skewed shots to be scored.

When practicing with the target 10, the archer can take any shooting position relative to the target. The archer can shoot from above, below, in front of, or behind the target, as well as from the usual broadside standing position. The target user scores or determines the accuracy of the arrow shot by viewing the target insert 30 through the opening 28. This can be accomplished without removing the arrow 50 or the insert 30. Since the strikes of the arrows 50 can be observed through the top opening 28, it is unnecessary to uncover the broadside portion of the target insert 30 or remove a portion of the shell 12. A successful hit is scored when the arrow 50 strikes the vital organ indicia 38 on the target insert 30. Higher scores might be assigned to hits which strike the heart-shaped member 40 than the lung-shaped member 42, if desired. The target 10 with its insert 30 provides a realistic, accurate and readily viewable representation of the internal penetration of the arrow 50.

Figure 4:
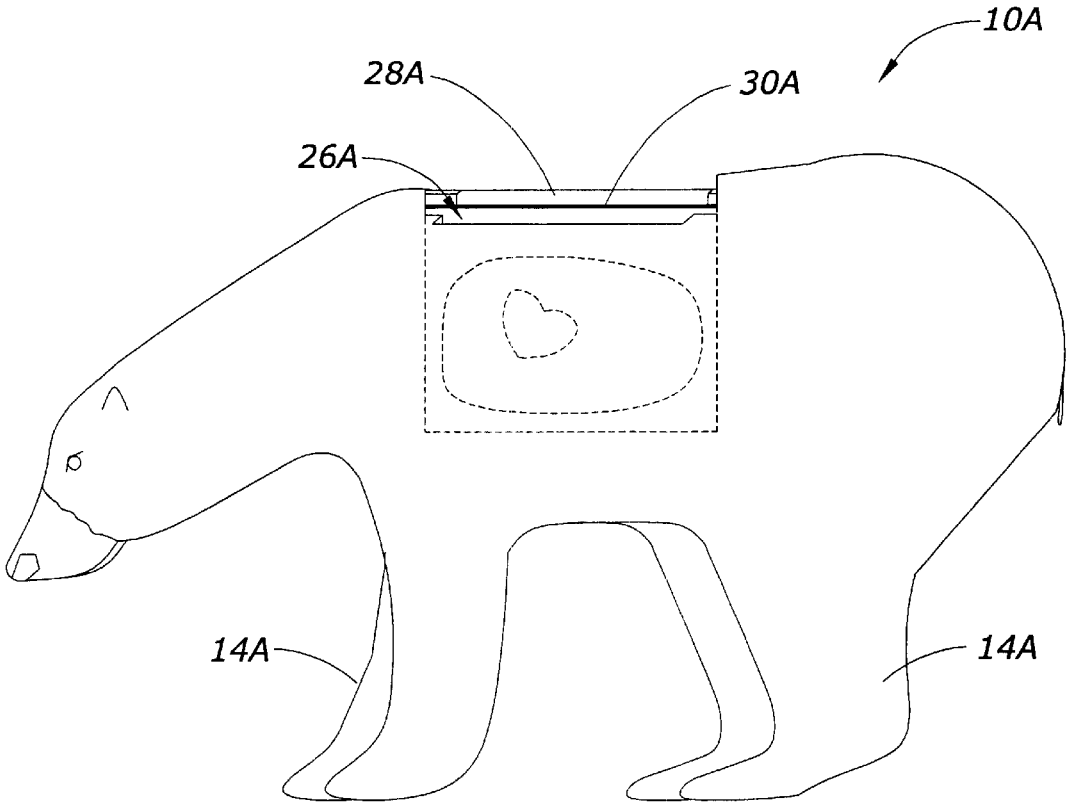
FIG. 4 is a perspective view of a three-dimensional archery target simulating a bear according to an alternative embodiment of the present invention.
Figure 5:
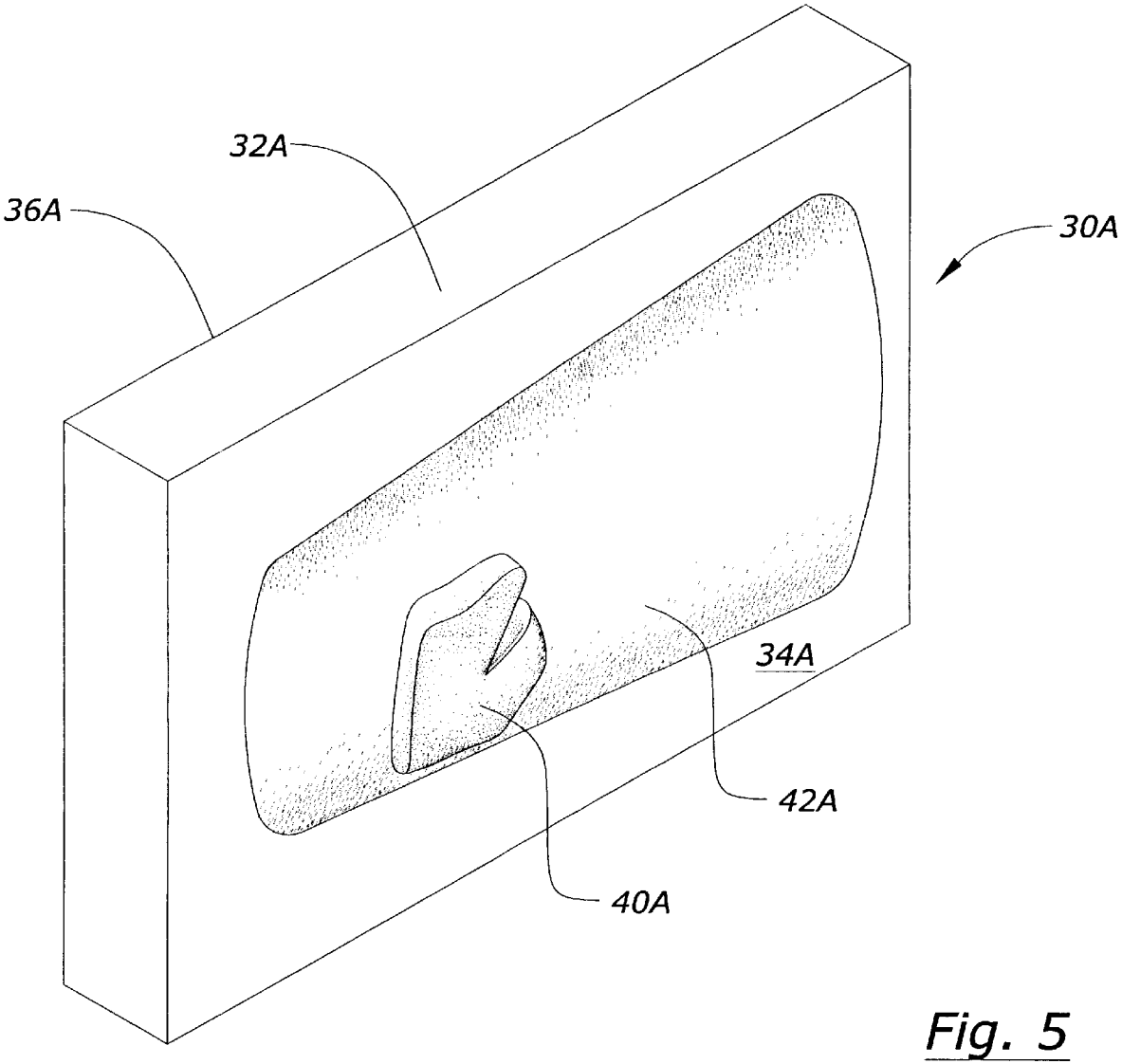
FIG. 5 is a perspective view of the target insert of FIG. 4.

Another exemplary embodiment of the present invention is shown in FIG. 4, wherein the game target 10A has a target shell 12A shaped into the form of a bear standing on all four legs 14A. FIG. 5 illustrates the target insert 30A utilized in the bear-like target 10A. The size, shape and location of the heart-shaped member 40A and the lung-shaped member 42A are adjusted to more closely simulate the anatomy of a bear. As with the deer-like target insert 30, the indicia 38 of the vital organs, such as 40A, 42A, can be located on the front surface 34A or both the front surface 34A and the rear surface 36A. Of course, the vital organ cavity 26A and the opening 28A must also be adjusted accordingly to slidably receive the insert 30A in a substantially anatomically correct location, but the illustration of FIG. 2 is still representative. The opening 28A is still located at the top of the target 10A.

Figure 6:
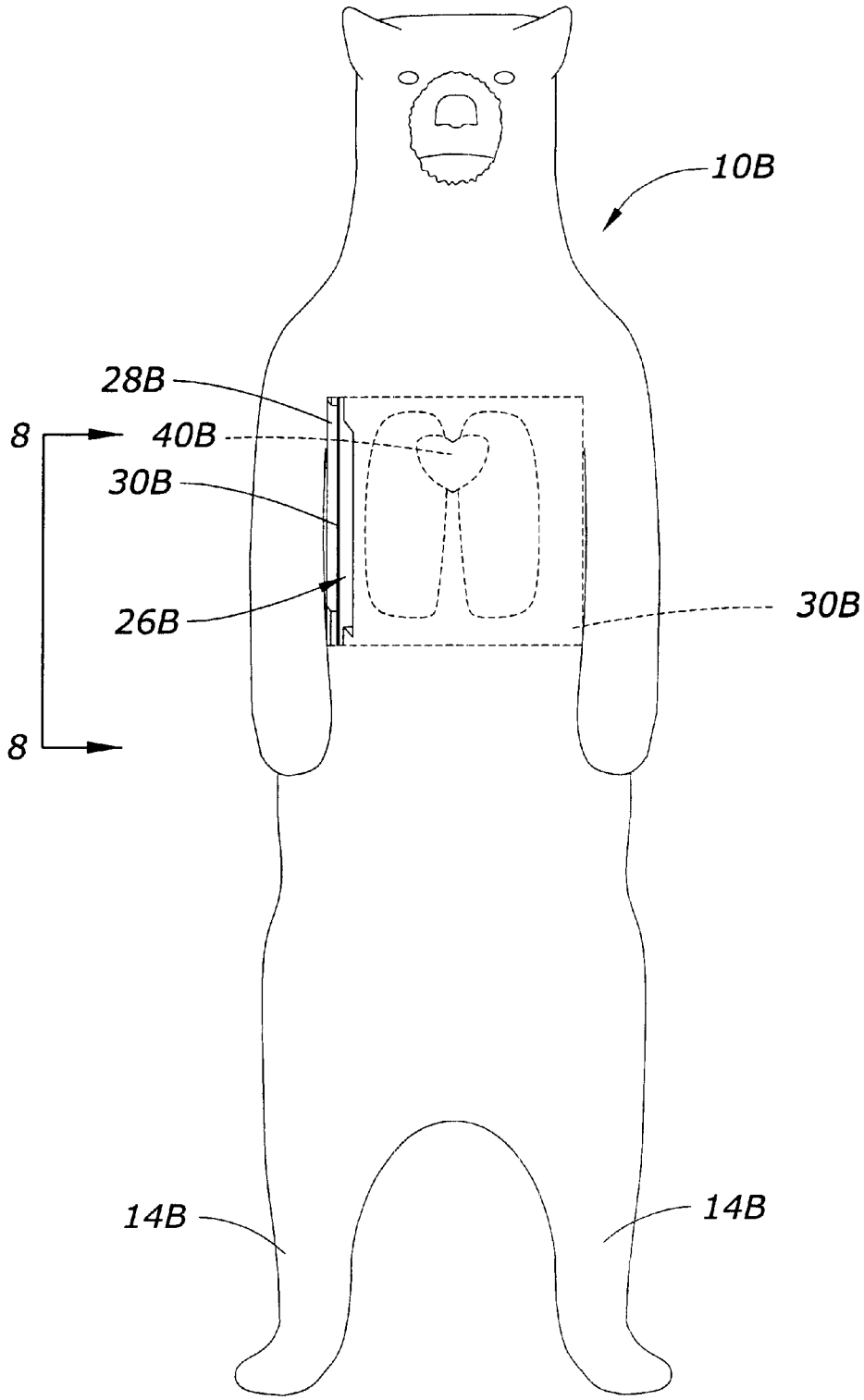
FIG. 6 is a perspective view of a standing bear according to an alternative embodiment of this invention.
Figure 7:
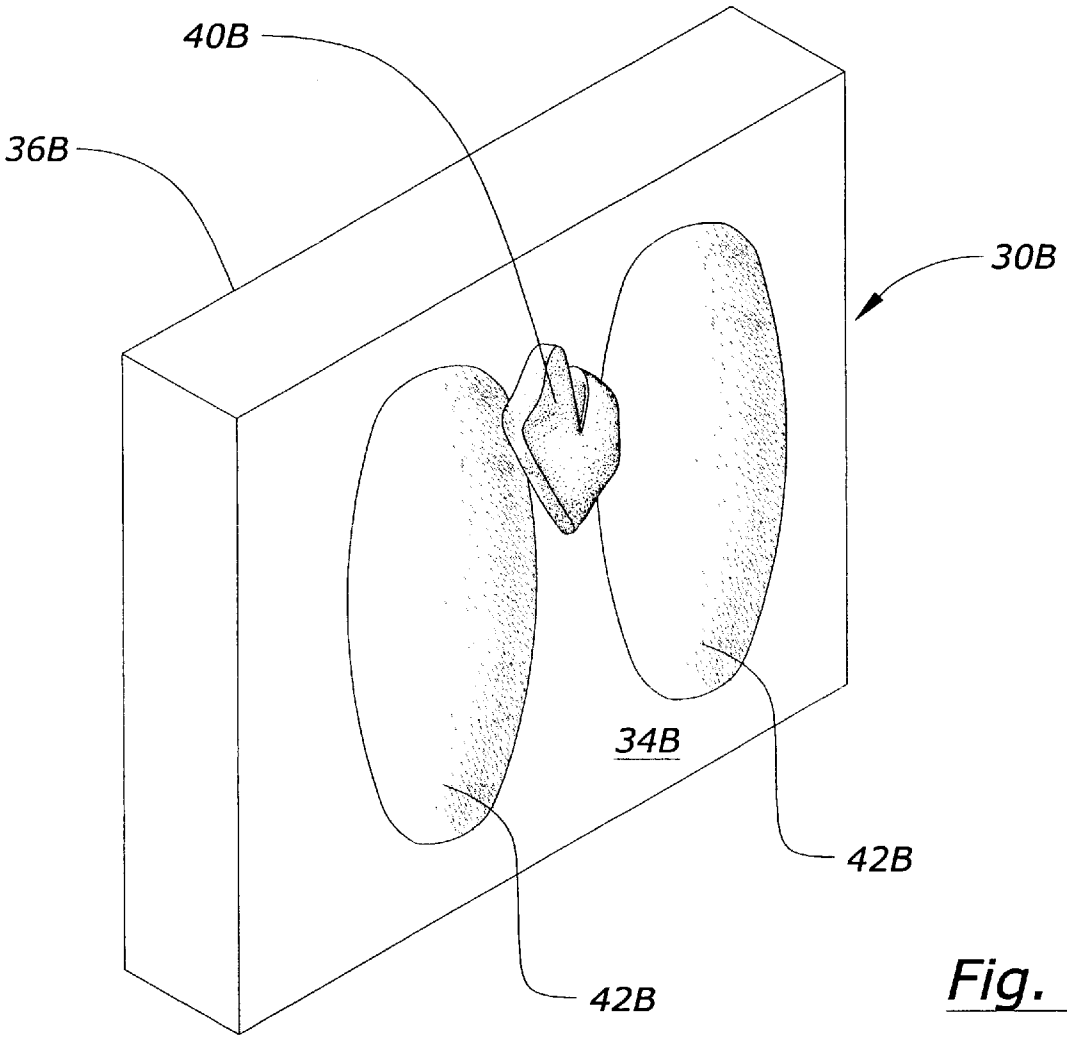
FIG. 7 is a perspective view of the target insert of FIG. 6.
Figure 8:
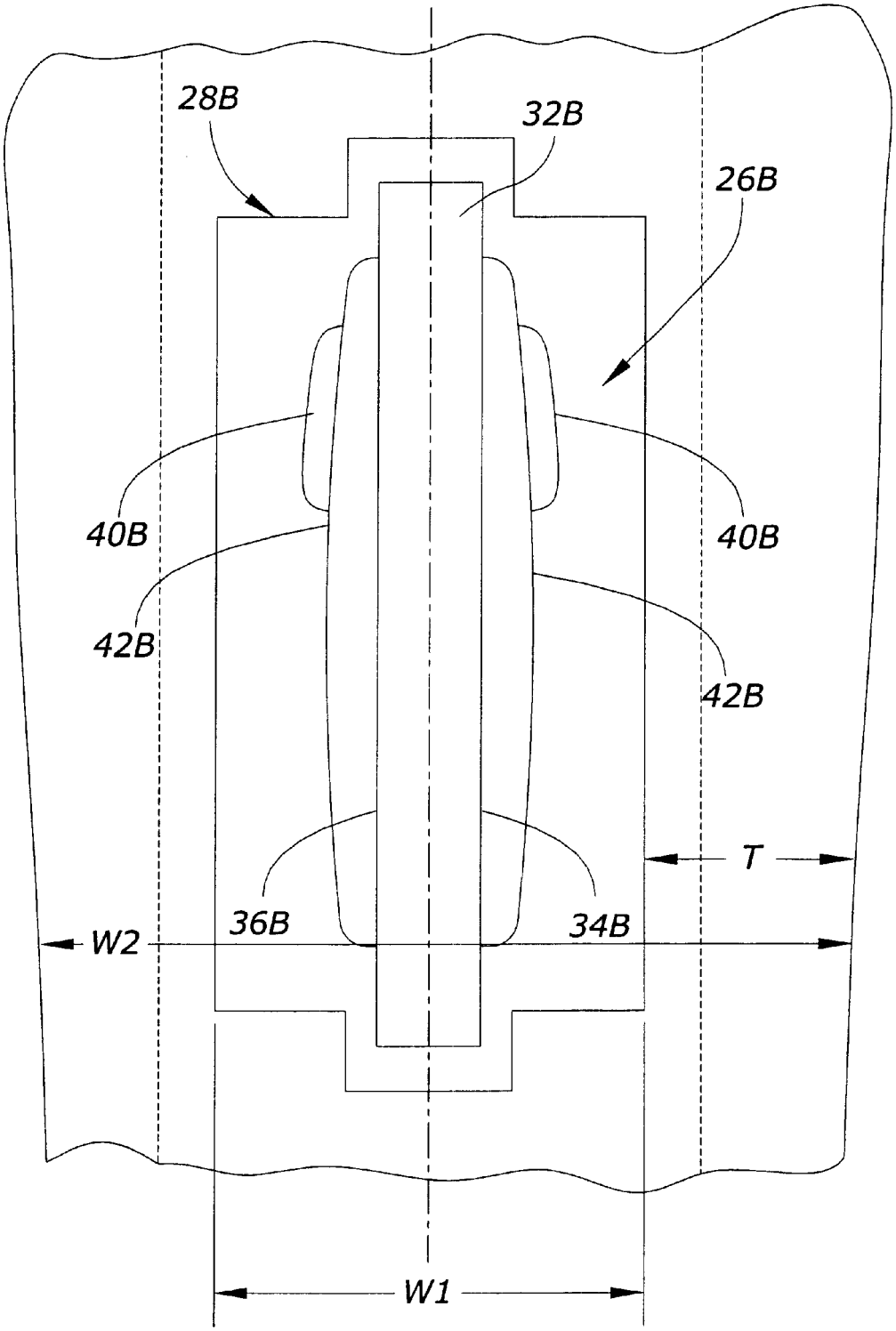
FIG. 8 is a partial elevational view of the left side of the thorax portion of the bear target taken along line 8—8 in FIG. 6.

Another exemplary embodiment of the present invention as shown in FIG. 6, wherein the target 10B simulates a bear standing on its two rear legs 14B. As illustrated in FIG. 7, the target insert 30B includes two lung-shaped members 42B on the front surface 34B of the base 32B. A heart-shaped member 40B is on the front surface 34B between the lung-shaped members 42B. The size, shape and location of the vital organ members 40B, 42B are adjusted to more closely simulate the anatomy of a bear standing on its hind legs. Of course, the vital organ cavity 26B and the opening 28B must also be adjusted accordingly to slidably receive the insert 30B in a substantially anatomically correct location. Thus, the opening 28B is located at the right or left side of the target 10B. The cavity 20B extends along a vertical plane of symmetry that bisects the target 10B into similar front and rear shell halves. As with the deer-like target insert 30, the indicia 38 of the vital organs, such as 40B, 42B, can be located on the front surface 34B or both the front surface 34B and the rear surface 36B. FIG. 8 is a view of the opening 28B, cavity 26B and the insert 30B for the standing bear target 10B. The user scores shots, as well as removes and installs the target insert 30B from the side of the target 10B.

Thus, it can be seen that the present invention at least satisfies its stated objectives. The invention is also adaptable for providing targets for other types of projectiles, including but not limited to darts, bullets, and pellets. Almost any animal could be simulated, even a human.

In the drawings and specifications, there has been set forth a preferred embodiment invention, and although specific terms are employed, these are used in a generic and descriptive sense only and not for purposes of limitation. Changes in the form, proportion, and relative location of parts as well as in the substitution of equivalents are contemplated as circumstances may suggest or render expedient without departing from the scope of the invention as defined in the following claims.

What is claimed is:

1. A target comprising:

a target shell three-dimensionally shaped into the form of an animal, the shell having a vital organ cavity extending inwardly from an elongated opening in the shell;

a removable target insert slidably inserted in the vital organ cavity through the opening, the insert including indicia thereon representing vital organs of the animal such that the location of a projectile shot into the target relative to the indicia representing vital organs can be determined by viewing the insert through the opening without removing the projectile from the target; and the insert being three-dimensional and including a core and raised surfaces protruding from the core so as to resemble vital organs.

2. The target of claim 1 wherein the vital organs include a heart and a lung of the animal.

3. The target of claim 1 wherein the target shell is shaped in the form of a deer.

4. The target of claim 1 wherein the target shell is shaped in the form of a bear.

5. The target of claim 1 wherein the cavity extends along a vertical plane of symmetry of a thorax portion of the shell.

6. The target of claim 5 wherein the opening is in a top portion of the shell.

7. The target of claim 6 wherein the opening is in a side portion of the shell.

8. A three-dimensional archery game target comprising:

a target shell shaped into the form of an animal and having a vital organ cavity extending inwardly from an elongated opening in the shell; and a removable three-dimensional target insert slidably inserted in the vital organ cavity through the opening, the insert including a core and raised surfaces defining indicia thereon representing vital organs of the animal such that accuracy of an arrow shot into the target relative to the indicia representing vital organs can be determined by viewing the insert through the opening without removing or uncovering the insert.

9. The target of claim 8 wherein the shell has a wall thickness adjacent the vital organ cavity that approximately equals a wall thickness of a flank of the animal.

10. A method of determining accuracy of arrow shots into a game target comprising the steps of:

shooting an arrow into the game target from any angle;

scoring a successful hit whenever the arrow strikes a raised surface of a three-dimensional vital organ simulating insert disposed inside a vital organ cavity of the game target; and said scoring being done without removing the insert from the target and without exposing the insert for broadside viewing.

* * * * *